US006408547B1

(12) United States Patent
Jones et al.

(10) Patent No.: US 6,408,547 B1
(45) Date of Patent: Jun. 25, 2002

(54) SHOCK-ABSORBENT SNOWPLOW MOUNT

(75) Inventors: Daniel K. Jones, deceased, late of Madison, by Jayson D. Jones, legal Representative; *by Justine Mascari, legal representative*, Sun Prairie; Jayson D. Jones, Madison, all of WI (US)

(73) Assignee: Burke Truck & Equipment, Inc., Sun Prairie, WI (US)

( * ) Notice: Subject to any disclaimer, the term of this patent is extended or adjusted under 35 U.S.C. 154(b) by 0 days.

(21) Appl. No.: 09/728,679

(22) Filed: Dec. 1, 2000

Related U.S. Application Data

(60) Provisional application No. 60/168,956, filed on Dec. 3, 1999.

(51) Int. Cl.[7] ..... E01H 5/04

(52) U.S. Cl. ..... 37/232

(58) Field of Search ..... 37/232, 234, 235, 37/236, 266, 270, 271, 279, 283, DIG. 20; 172/818–823, 828, 829

(56) References Cited

U.S. PATENT DOCUMENTS 4,307,523 A * 12/1981 Reissinger et al. ..... 37/262
4,402,394 A * 9/1983 Stoll ..... 198/489
4,570,367 A 2/1986 Oya
4,947,563 A 8/1990 Pfister, Jr.
4,976,054 A 12/1990 Jones
5,437,113 A 8/1995 Jones
6,088,937 A 7/2000 DiClementi et al.

* cited by examiner

*Primary Examiner*—Robert E. Pezzuto
(74) *Attorney, Agent, or Firm*—Craig A. Fieschko, Esq.; DeWitt Ross & Stevens S.C.

(57) ABSTRACT

A snowplow mount is provided wherein a vehicle mount extending from the plowing vehicle is affixed to a reversing table, which is in turn rotatably connected to a plow moldboard at one or more pivots. One of the moldboard or the reversing table includes a bearing thereon, the bearing having a bearing bore defined therein. The other of the moldboard or the reversing table includes a pin which is elastically journalled within the bearing so that the pin and bearing may both rotate with respect to each other as well as translate with respect to each other in radial directions (i.e., in planes which are generally parallel to the axes of the pin and the bearing bore). Thus, loading of the moldboard allows the moldboard to translate with respect to the reversing table at the pivot as well as rotate. The reversing table is rotatably affixed to the vehicle mount with a linear actuator affixed therebetween so that actuation of the linear actuator will cause the reversing table to rotate with respect to the vehicle mount. The linear actuator is elastically mounted between the reversing table and vehicle mount so that the two may rotate a slight amount with respect to each other, with such rotation being elastically resisted. As a result, shock loading of the moldboard (and thus the reversing table) will not be readily transmitted to the linear actuator.

20 Claims, 2 Drawing Sheets

SHOCK-ABSORBENT SNOWPLOW MOUNT

CROSS-REFERENCE TO RELATED APPLICATIONS

This application claims priority under 35 USC §119(e) to U.S. Provisional Patent Application No. 60/168,956 filed Dec. 3 1999, the entirety of which is incorporated by reference herein.

FIELD OF THE INVENTION

This disclosure concerns an invention relating generally to shock-absorbing devices for snowplows, and more specifically to shock-absorbing devices for assemblies which mount snowplow moldboards to their plowing vehicles.

BACKGROUND OF THE INVENTION

Most moldboards for snowplows are affixed to their plowing vehicles by an assembly which will be referred to herein as a vehicle mount, which may take a variety of forms. Often, the vehicle mount includes a mounting frame which is permanently or removably attached to the plowing vehicle. A support frame, which is often provided as a truss-like structure commonly referred to as an A-frame, bears the moldboard and removably attaches to the mounting frame so that the support frame (and its associated moldboard) can be removed from the vehicle. The moldboard is often pivotally affixed to the support frame (and more generally to the vehicle mount) by an assembly referred to as a reversing table so that the reversing table and moldboard may rotate in one or more degrees of freedom with respect to the vehicle mount, e.g., in a horizontal plane so that the moldboard can be reoriented from one side of the plowing vehicle to the other. The moldboard may also be pivotally connected to the reversing table (or to the vehicle mount) so that the moldboard may rotate about a horizontal axis to enable the moldboard to be raised and lowered. Reference can be made to U.S. Pat. No. 4,976,054 to Jones, and to the patents referenced therein, for illustrations of a variety of reversing table and vehicle mount arrangements. The moldboard may include a lower trip edge, i.e., a spring-loaded lower plowing edge, which yields under impact to avoid damage to the moldboard; see, e.g., U.S. Pat. No. 5,437,113 to Jones and the patents referenced therein.

The foregoing assembly is subjected to a great deal of wear owing to road vibration and impact loading, and since failure can lead to significant cost and inconvenience, plow manufacturers strive to develop means for minimizing wear. In particular, the pivots at which the moldboard rotates with respect to the reversing table, and the connections by which the reversing table rotates with respect to the vehicle mount, are subject to problems because these are generally the first points at which the assembly will fail. Thus far, the solution for such failure has generally been to fortify the structure of the vehicle mount, reversing table, and moldboard at these points. This has the disadvantages that it increases the weight and cost of the assembly, and complicates repairs when such are finally needed.

SUMMARY OF THE INVENTION

The invention, which is defined by the claims set forth at the end of this document, is directed to shock-absorbing devices for plows which at least partially alleviate the aforementioned problems. A basic understanding of some of the preferred features of the invention can be attained from a review of the following brief summary of the invention, with more details being provided elsewhere in this document.

Plows made in accordance with the invention preferably include at least one of the following features:

(1) The plow moldboard is affixed to a plow reversing table at one or more pivots which allow the moldboard to be rotatably repositioned with respect to the reversing table. One of the moldboard or the reversing table includes a bearing thereon, with the bearing having a bearing bore defined therein. The other of the moldboard or the reversing table includes a pin which is elastically journalled within the bearing bore so that the pin and bearing may rotate with respect to each other, and additionally translate with respect to each other in radial directions (i.e., in planes which are generally parallel to the axes of the pin and the bearing bore). Therefore, the pin will translate within the bearing when the moldboard is subjected to loading. Such translation will help to delay triggering of any trip edge situated on the moldboard, and will thereby help avoid the shock that occurs from such triggering and allow the pivots to avoid breakage. The elastic journalling may be accomplished by interposing a bushing between the bearing and the pin wherein the bushing is at least partially elastic. The bushing preferably includes a rigid inner sleeve wherein the pin is received, and an elastic outer sleeve wherein the inner sleeve is situated. The inner sleeve and outer sleeve are preferably bonded together so as to prevent the two from separating under loading, which can promote wear between the inner and outer sleeves.

(2) The reversing table is rotatably affixed to the vehicle mount with a linear actuator affixed therebetween so that actuation of the linear actuator will cause the reversing table to rotate with respect to the vehicle mount. The linear actuator is elastically mounted between the reversing table and vehicle mount so that the two may rotate a slight amount with respect to each other (with such rotation being elastically resisted), and so that shock loading of the moldboard (and thus the reversing table) will not be readily transmitted to the linear actuator. The linear actuator is preferably mounted to at least one of the vehicle mount and the reversing table by an actuator anchor wherein an elastic cushion is fit between the linear actuator and actuator anchor. The actuator anchor may have a mounting bore in which the linear actuator is slidably fit, and an elastic cushion may be fit about the linear actuator and closely between the linear actuator and actuator anchor. Then, when the linear actuator translates within the mounting bore of the actuator anchor, the elastic cushion will be compressed or expanded by a corresponding amount.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
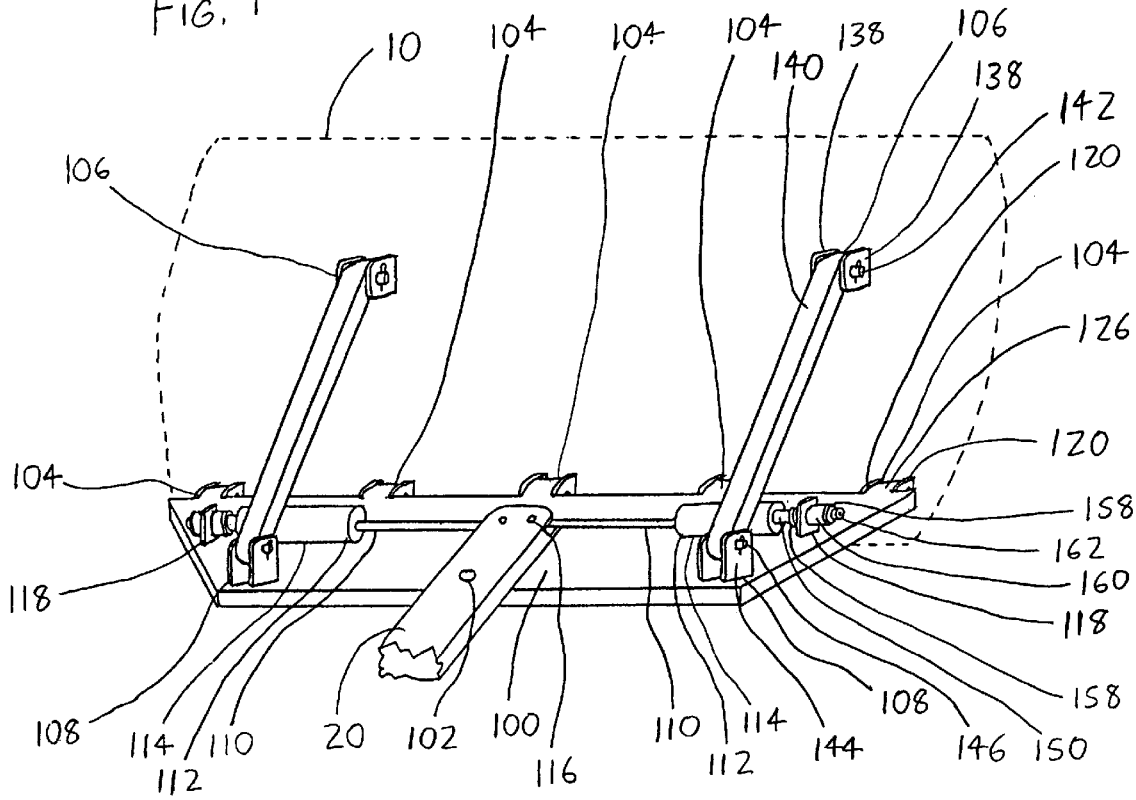
FIG. 1 is a rear perspective view of an exemplary moldboard reversing table, with the moldboard being illustrated in phantom lines.

Referring to FIG. 1, an exemplary embodiment of the invention is shown from the rear, i.e., from the front of a plowing vehicle (not shown) and facing forwardly towards the rear of a moldboard 10 (shown in phantom). A portion of a vehicle mount 20 extends forwardly to be pivotally anchored to a reversing table 100 at a table pivot 102. The moldboard 10 is pivotally affixed with respect to the reversing table 100 about a horizontal axis at several pivots which will be referred to herein as base pivots 104, forward upper pivots 106, and rear lower pivots 108. (It is noted that actuators and/or other structures for lifting the moldboard 10 are not shown in the drawings.) These pivots 104/106/108, being the juncture points between the moldboard 10 and the reversing table 100, are subject to significant wear owing to road vibration and also to shock from impacts between the moldboard 10 and objects in the plowing path. This problem and others are addressed by the pivot arrangement discussed later in this document. The reversing table 100 is rotatably driven about a generally horizontal plane with respect to the vehicle mount 20 by one or more linear actuators 110, depicted in FIG. 1 by a pair of hydraulic cylinders. The linear actuators 110 include pistons 112 driven by cylinders 114, with the pistons 112 being pivotally affixed to the vehicle mount 20 at piston pins 116 and the cylinders 114 being anchored to the reversing table 100 at actuator anchors 118. Thus, when one of the linear actuators 110 is extended and the other is retracted, the reversing table 100 will be rotated with respect to the vehicle mount 20 about the table pin 102. Since the moldboard 10 is generally subject to highly uneven loads about its length during plowing—for example, when one side of the moldboard 10 strikes a curb or other object—the moldboard 10 and the reversing table 100 will often attempt to rotate with respect to the vehicle mount 20, with the linear actuators 110 providing the only resistance to such rotation. The linear actuators 110 are therefore highly susceptible to damage when impact occurs. This and other problems are addressed by the anchoring arrangement for the linear actuators 110 discussed later in this document.

Figure 2:
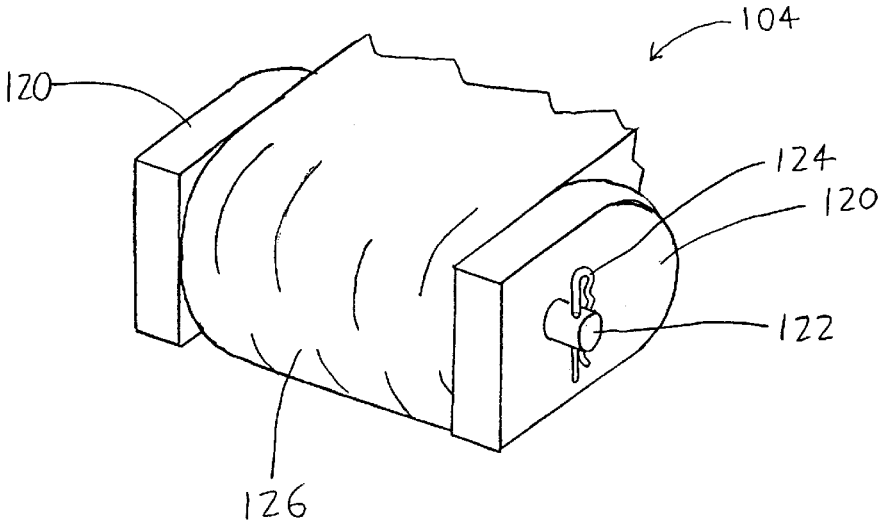
FIG. 2 is a front perspective view of one of the base pivots 104 of FIG. 1, shown with the moldboard 10 and reversing table 100 removed.
Figure 3:
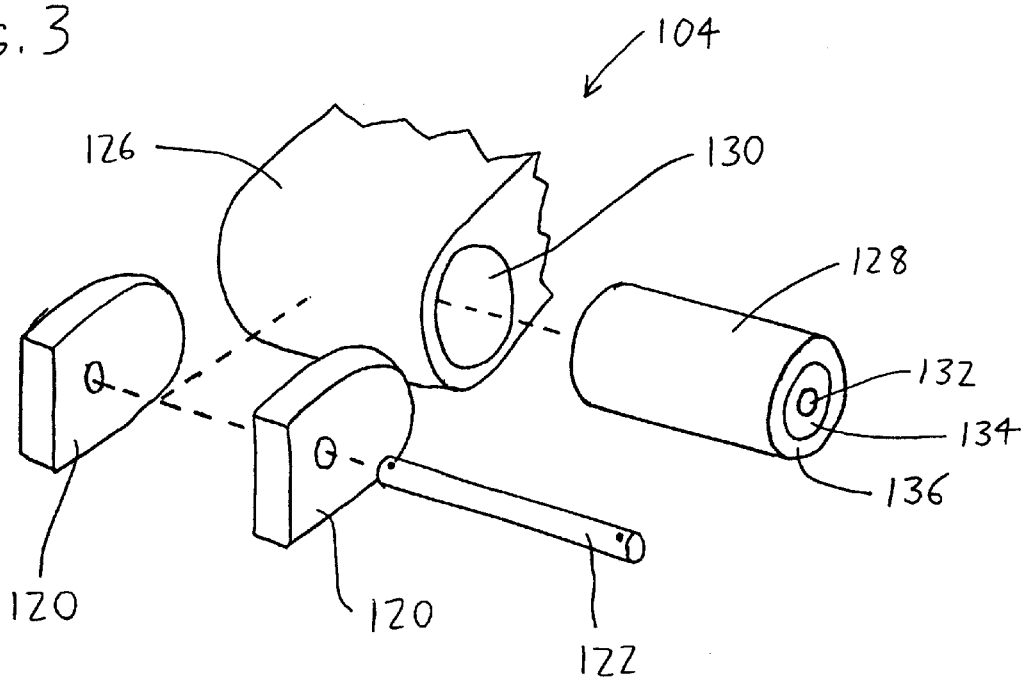
FIG. 3 is an exploded view of the base pivot 104 of FIG. 2.

Turning first to the pivot arrangement between the moldboard 10 and reversing table 100, the structure of the base pivots 104, forward upper pivots 106, and rear lower pivots 108 will now be discussed in greater detail. Looking initially at the base pivots 104, these are best visualized with reference to FIG. 2, wherein a base pivot 104 is illustrated from the front, i.e., looking rearwardly from the moldboard 10 (with the moldboard 10 not being shown in FIG. 2). A pair of horizontally-spaced ears 120 extend rearwardly from the moldboard 10, and have a pin 122 extending therebetween. The pin 122 shown in FIG. 2 is removably inserted within the ears 120 and is anchored thereto by means of cotter pins 124 removably inserted within the pin 122. A bearing 126 then pivotally receives the pin 122 and extends rearwardly away from the moldboard 10 to connect to the reversing table 100 so that the ears 120, pin 122, and bearing 126 form a clevis-like arrangement between the moldboard 10 and the reversing table 100. The journalling arrangement between the pin 122 and the bearing 126 is then illustrated in greater detail in the exploded view of FIG. 3, wherein it is seen that a bushing 128 is interposed between the pin 122 and the bearing 126. The bearing 126 is seen to have an enlarged bearing bore 130 wherein the bushing 128 is complementarity fit, with the pin 122 then being fit within a bushing bore 132 in the bushing 128. The bushing 128 is at least partially elastic so that the pin 122 is elastically journalled within the bearing bore 130 so that the pin 122 may not merely rotate within the bushing 128, but may also translate in a radial direction along planes defined on its axis when a force on the moldboard 10 is transmitted between the bearing 126 and the pin 122, with the bushing 128 yielding to allow such translation. This could be accomplished by making the bushing 128 entirely out of an elastic material such as rubber, but a particularly preferred and low-wear arrangement is to form the bushing 128 of a rigid (e.g., metal) inner sleeve 134 wherein the pin 122 is received, and an elastic outer sleeve 136 wherein the inner sleeve is situated. This arrangement promotes rotation between the wear-resistant inner sleeve 134 and the pin 122 rather than between the softer outer sleeve 136 and the bearing bore 130, and thereby promotes longer life.

It is particularly preferable to have the bushing inner sleeve 134 bonded to the bushing outer sleeve 136, as by vulcanizing a rubber outer sleeve 136 onto a steel inner sleeve 134. This has been found to perform better than the case where an inner sleeve 134 is removably inserted within the outer sleeve 136, since non-joined inner and outer sleeves 134 and 136 can separate under load, thereby causing wear on the inner surface of the, outer sleeve 136 (i.e., between the inner and outer sleeves 134 and 136) as well as on the outer surface of the outer sleeve 136. In contrast, bonding the inner and outer sleeves 134 and 136 causes wear to primarily occur at the outer surface of the outer sleeve 136, thereby providing a longer lifetime.

Regarding the outer sleeve 136, virgin rubber of 70 durometer was initially tested, and was found to work well. However, tests of virgin rubber of 45 durometer are underway at the time of this writing, and it is believed that these may exhibit superior performance; while they are softer and seemingly more prone to wear, the rubber will tend to gain rigidity under the cold conditions in which the snowplow is used, and it is believed that it may exhibit more desirable damping properties in below-freezing weather. Virgin rubber is preferred over synthetic rubber because it is more resistant to hydraulic and road oil, and it is additionally more resistant to cracking when subjected to large temperature swings.

The following dimensions for the bushing 128 have been found to be useful: 3 inches for the outer diameter of the outer sleeve 136; 1.625 inches for the inner diameter of the outer sleeve 136/outer diameter of the inner sleeve 134; and 1 inch for the inner diameter of the inner sleeve 134.

If desired, similar bushing arrangements can be implemented for one or more of the forward upper pivots 106 and rear lower pivots 108. The forward upper pivots 106 are illustrated in FIG. 1 as being provided by ears 138 extending rearwardly from the moldboard 10 and receiving bridging links 140 which extend toward the reversing table 100, with the bridging links 140 having bushed bearings as previously described. Pins 142 extend between the ears 138 through the bearings and bushings of the bridging links 140. At the reversing table 100, the bridging links 140 are received between ears 144 with the ends of the bridging links 140 again containing bushed bearings as previously described. Pins 146 extend between the ears 144 through the bearings and bushings of the bridging links 140.

Tests have found that the aforementioned pivot arrangement leads to a number of beneficial results. Initially, since the pins are elastically journalled within their bearing bores, they wear much less quickly under road vibration and moldboard impacts than where a standard non-elastic journalling arrangement is implemented. This is highly beneficial because the pins and ears in standard arrangements wear out very quickly, particularly under road vibration, and they are expensive and time-consuming to replace (particularly in the case of worn ears, which need total removal and replacement). Furthermore, where trip edges are used on plow moldboards, the pivots help to damp the elastic action of the trip edge and delay its folding. This promotes better plowing action since the trip edge is less susceptible to undesired tripping, and additionally it further helps to avoid shock arising from the trip edge's snapping forward and backward.

Figure 4:
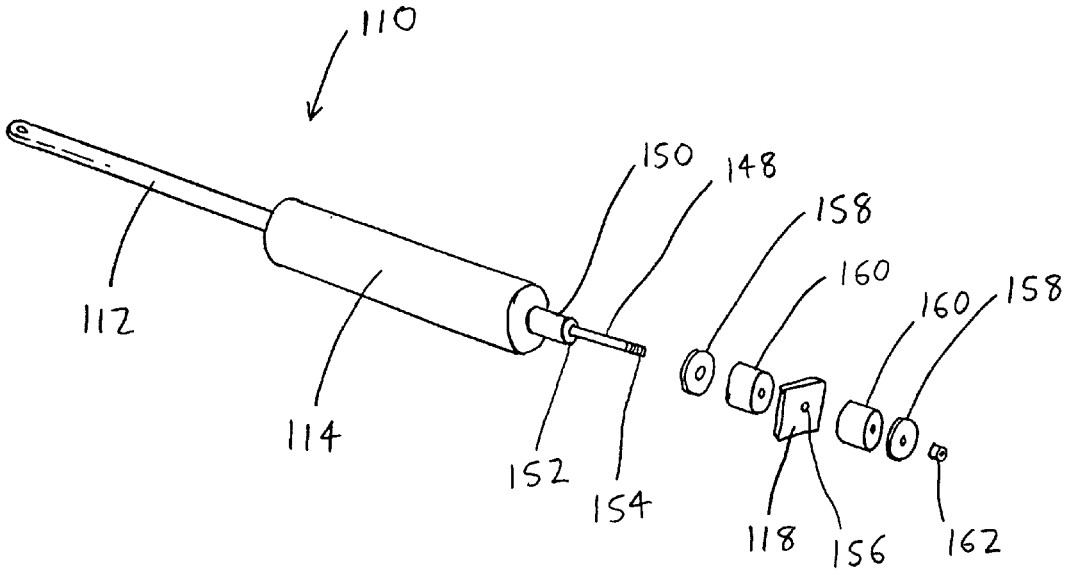
FIG. 4 is an exploded perspective view of the linear actuator 110 and actuator anchor 118 of FIG. 1.

The elastic anchoring arrangement between the linear actuators 110 and the reversing table 100 and/or vehicle mount 20 will now be discussed. Turning to FIG. 4, the rightmost linear actuator 110 of FIG. 1 is illustrated in an exploded view without the surrounding structure. As previously noted, the linear actuator 110 includes a cylinder 114 and a piston 112, with the end of the piston 112 being rotatably connected to the vehicle mount 20 (not shown in FIG. 4). On the cylinder 114 land opposite the piston 112, a mounting rod 148 extends outwardly from a larger-diameter cylinder stem 150 so that a land 152 is defined therebetween. The mounting rod 148 terminates in a threaded end 154. The mounting rod 148 extends through a mounting bore 156 defined in the actuator anchor 118, which is affixed to the reversing table 100 (not shown in FIG. 4). The mounting rod 148 additionally extends through a pair of collar-like stops 158 and elastic cushions 160, wherein the elastic cushions 160 are situated on the opposing sides of the actuator anchor 118 and between the stops 158. The stop 158 closest to the cylinder 114 bears against the land 152 so that the stop 158 and its adjacent cushion 160 are held spaced from the cylinder 114. On the opposite side of the actuator anchor 118, a nut 162 is affixed to the threaded end 154 of the mounting rod 148 and is sufficiently tightened that the stops 158 and elastic cushions 160 are pushed toward the actuator anchor 118. Thus, when the linear actuator 110 of FIG. 4 retracts, the nut 162 will bear against its adjacent stop 158, which will in turn compress its adjacent elastic cushion 160 against the actuator anchor 118. Similarly, when the linear actuator 110 extends, the land 152 will force the stop 158 against its adjacent elastic cushion 160, which compresses against the actuator anchor 118. The elastic cushions 160 are slidably received on the mounting rods 148 of the linear actuators 110 so that they may freely expand and compress on the mounting rods 148. The elastic cushions 160, being maintained between the linear actuators 110 and their actuator anchors 118, thereby receive force exerted therebetween and contract or expand accordingly. Keeping in mind that impact shock transmitted from the moldboard 10 to the reversing table will be transmitted to the actuator anchor 118, then to the linear actuator 110, and finally to the vehicle mount 20, the elastic cushions 160 help to absorb shock transmitted from the moldboard 10 by elastically compressing or expanding, thereby preventing undue stress in the linear actuators 110.

Suitable dimensions for the elastic anchoring arrangement shown in FIG. 4 are: 2 inch outer diameter for the cylinder stem 150; 1.5 inch outer diameter for the mounting rod 148; 0.5 inch thick steel plate for the stops 158, with 4 inch outer diameter and 1.5 inch inner diameter; the elastic cushions 160 being 1.75 inch wide virgin rubber bushings with 4 inch outer diameter and 1.5 inch inner diameter; and the actuator anchors 118 being 5 inch by 5 inch steel plate, 1 inch thick, with a 1.65 inch diameter mounting bore 156. Note that the mounting bore 156 preferably has slightly greater size than the mounting rod 148 so that there is a bit of play therebetween, which is useful to allow a small degree of pivoting of the mounting rod 148 within the mounting bore 156. It is desirable to have at least a small degree of pivoting between the linear actuators 110 and the actuator anchors 118 since the pivoting arrangement about the table pin 102 between the reversing table 100 and the vehicle mount 20 generally tends to change the orientation of the axis of the mounting rod 148 within the mounting bore 156.

It should be understood that in the foregoing discussion, exemplary versions of the invention were shown and described, and the invention may take different forms. Following is a nonexhaustive list of possible modifications that can be made.

Regarding the base pivots 104, forward upper pivots 106, and rear lower pivots 108, these were described as having pins 122, 142, and 146 removably inserted within ears 120, 138, and 144. It should be understood that these pins could instead be permanently affixed to the ears, or could be removably anchored within the ears by fixture means other than cotter pins 124 (e.g., by nuts). A removable pin arrangement is particularly preferred because this promotes easy replacement of the relatively low-cost bushings 128.

More generally, the pivots 104, 106, and 108 previously described may take forms other than those discussed and shown; for example, the base pivots 104 may include ears extending from the reversing table 100 and bearings extending from the moldboard 10 rather than ears 120 extending from the moldboard 10 and bearings 126 extending from the reversing table 100. The same is true of the forward upper pivots 106 and rear lower pivots 108. Additionally, the pivots 104/106/108 need not utilize flange-like ears 120/138/144 for mounting the pins 122/142/146, and may instead utilize non-flange-like mounting structures, e.g., monolithic blades, wherebetween the pins are received. Additionally, the pivots 104/106/108 need not utilize a clevis-like structure wherein the bearing is pinned between a pair of mounting structures; instead, the bearings may merely be pivotally affixed to a single adjacent mounting structure.

Regarding the elastic anchoring arrangement between the linear actuator 110 and the reversing table 100, numerous aarangements other than those shown in FIGS. 1 and 4 may be used. For example, it is possible to include multiple elastic cushions 160 on either side of the actuator anchor 118, including elastic cushions 160 having different degrees of elasticity to obtain different kinds or degrees of elastic/damping behavior. It is additionally possible to omit the use of elastic cushions 160 on one of the sides of the actuator anchors 118, though the use of elastic cushions 160 on both sides of the actuator anchors 118 is preferred. The use of elastic cushions which are interposed between the linear actuators 110 and the actuator anchors 118, but which do not ride on the linear actuator 110, is also possible. It is noted that in the foregoing discussion, the linear actuator 110 is described as being received within the mounting bore 156 of the actuator anchor 118 (with the mounting rod 148 being illustrated as resting in the mounting bore 156). It should therefore be apparent that structure associated with the linear actuator 110 other than its piston 112 and cylinder 114 can be movably mounted to the actuator anchor 118, such as protruding rods or other structures. Additionally, the stops 158 may be omitted so that the elastic cushions 160 are situated directly between the land 152 and the actuator anchor 118, and between the nut 162 and the actuator anchor 118, though the stops 158 beneficially act as washers which allow transmission of force along the full diameters of the elastic cushions 160. The elastic cushions 160 need not be bushings formed of elastomeric material, but can instead be other elements which provide elastic biasing between linear actuators 110 and the actuator anchors 118, such as springs or pneumatic cylinders/chambers.

It should also be understood that the attachment shown in FIG. 1 between the reversing table 100, linear actuators 110, and vehicle mount 20 is merely an exemplary one, and many other arrangements are possible. For example, less or more than two linear actuators 110 may be used, and the linear actuators 110 may be pivotally or non-pivotally affixed to either or both of the vehicle mount 20 and the reversing table 100. Thus, the arrangement shown in FIG. 1, wherein a pair of linear actuators 110 are shown pivotally affixed to the vehicle mount 20 and non-pivotally affixed to the reversing table 100, may be replaced by an arrangement wherein linear actuators 110 are non-pivotally affixed to the vehicle mount 20 and pivotally affixed to the reversing table 100, or pivotally affixed to both of the vehicle mount 20 and the reversing table 100, etc. Also, rather than affixing the piston 112 of the linear actuator 110 to the vehicle mount 20 and its cylinder 114 to the reversing table 100, one could instead affix the cylinder 114 to the vehicle mount 20 and then elastically anchor the piston 112 to the reversing table 100.

Finally, the pins, bushings, mounting rods, elastic cushions, etc. are not limited to the configurations and sizes shown, and wide variations in shape and size are possible. As examples, the bushing 128 could have a non-circular cross-section (as seen from its axis); the elastic cushions 160 could have non-cylindrical shapes; and so forth.

The invention is not intended to be limited to the preferred versions described above, but rather is intended to be limited only by the claims set out below. Thus, the invention encompasses all alternate versions that fall literally or equivalently within the scope of these claims.

What is claimed is:

1. A plow comprising:

a. a vehicle mount;

b. a reversing table rotatably affixed with respect to the vehicle mount;

c. a linear actuator affixed between the vehicle mount and reversing table whereby actuation of the linear actuator causes rotation of the reversing table with respect to the vehicle mount, the linear actuator being elastically anchored to one of the vehicle mount and the reversing table;

d. a moldboard rotatably affixed with respect to the reversing table at one or more pivots, each pivot including;

(1) a bearing anchored to one of the moldboard and the reversing table, the bearing having a bearing bore;

(2) a pin anchored to the other one of the moldboard and the reversing table to which the bearing is not anchored, the pin being elastically journalled within the bearing bore so that it may translate in a radial direction therein when a radially-oriented force is exerted between the bearing and the pin.

2. The plow of claim 1 wherein the pin is elastically journalled within the bearing bore by a bushing, the bushing being at least partially elastic.

3. The plow of claim 2 wherein the bushing includes:

a. a rigid inner sleeve wherein the pin is received, and b. an elastic outer sleeve wherein the inner sleeve is situated.

4. The plow of claim 3 wherein the inner sleeve is bonded to the outer sleeve.

5. The plow of claim 1 wherein:

a. an actuator anchor is affixed to one of the vehicle mount and the reversing table, the actuator anchor having a mounting bore defined therein;

b. the linear actuator is received within the mounting bore;

c. at least one elastic cushion is fit:

(1) about the linear actuator, and (2) adjacent to the actuator anchor outside its mounting bore, and wherein the linear actuator closely maintains the elastic cushion is against the actuator anchor;

wherein the linear actuator may be elongated and retracted to rotate the reversing table with respect to the vehicle mount, with the elastic cushion being maintained between the linear actuator and actuator anchor to receive force exerted therebetween.

6. The plow of claim 5 wherein the linear actuator has a stop included thereon, the stop being spaced from the portion of the linear actuator received within the mounting bore, wherein the elastic cushion is maintained between the stop and the actuator anchor.

7. The plow of claim 6 wherein the stop is provided by a collar fit about the linear actuator, with the elastic cushion being maintained between the collar and the actuator anchor.

8. The plow of claim 5 utilizing at least two elastic cushions, with the actuator anchor being interposed between a pair of the elastic cushions.

9. The plow of claim 8 wherein the linear actuator has stops included thereon, with the elastic cushions and actuator anchor being interposed between the stops whereby the stops maintain the elastic cushions closely adjacent to the actuator anchor.

10. A plow comprising:

a. a reversing table;

b. a moldboard rotatably affixed with respect to the reversing table at one or more pivots, each pivot including;

(1) a bearing anchored to one of the moldboard and the reversing table, the bearing having a bearing bore;

(2) a pin anchored to the other one of the moldboard and the reversing table to which the bearing is not anchored, the pin being elastically journalled within the bearing bore so that it may translate in a radial direction therein when a radially-oriented force is exerted between the bearing and the pin.

11. The plow of claim 10 wherein a bushing is interposed between the pin and the bearing, the bushing being at least partially elastic.

12. The plow of claim 11 wherein the bushing includes:

a. a rigid inner sleeve wherein the pin is received, and b. an elastic outer sleeve wherein the inner sleeve is situated.

13. The plow of claim 12 wherein the inner sleeve and outer sleeve are bonded together.

14. The plow of claim 10 further comprising:

a. a vehicle mount to which the reversing table is rotatably affixed;

b. a linear actuator affixed between the vehicle mount and reversing table whereby actuation of the linear actuator causes rotation of the reversing table with respect to the vehicle mount, the linear actuator being elastically anchored to one of the vehicle mount and the reversing table.

15. The plow of claim 14 wherein:

a. the one of the vehicle mount and the reversing table to which the linear actuator is elastically anchored bears an actuator anchor mounted thereon, with the linear actuator being slidably mounted within the actuator anchor;

b. the linear actuator bears a stop thereon;

c. the linear actuator is elastically anchored by an elastic cushion situated between the actuator anchor and the stop.

16. The plow of claim 10 further comprising:

a. a vehicle mount to which the reversing table is rotatably affixed;

b. a linear actuator affixed between the reversing table and the vehicle mount wherein:

(1) an actuator anchor is affixed to one of the vehicle mount and the reversing table, the actuator anchor having a mounting bore defined therein;

(2) the linear actuator is received within the mounting bore;

(3) at least one elastic cushion is fit:

i) about the linear actuator, and ii) adjacent to the actuator anchor outside its mounting bore, and wherein the linear actuator closely maintains the elastic cushion against the actuator anchor;

wherein the linear actuator may be elongated and retracted to rotate the reversing table with respect to the vehicle mount, with the elastic cushion being maintained between the linear actuator and actuator anchor to receive force exerted therebetween.

17. A plow comprising:

a. a vehicle mount;

b. a reversing table rotatably affixed with respect to the vehicle mount;

c. a linear actuator affixed between the vehicle mount and reversing table whereby actuation of the linear actuator causes rotation of the reversing table with respect to the vehicle mount, the linear actuator being elastically anchored to one of the vehicle mount and the reversing table, whereby force exerted between the vehicle mount and the reversing table will vary the position of the linear actuator with respect to the vehicle mount or the reversing table to which it is mounted.

18. The plow of claim 17 wherein the linear actuator is elastically anchored to one of the vehicle mount and the reversing table by an elastic cushion, the linear actuator being slidably received within the elastic cushion, and the elastic cushion being situated between the linear actuator and the one of the vehicle mount and the reversing table to which the linear actuator is elastically anchored.

19. The plow of claim 17 further comprising a moldboard rotatably affixed with respect to the reversing table at one or more pivots, each pivot including;

a. a pin anchored to one of the moldboard and the reversing table, b. a bushing journalled about the pin, the bushing being at least partially elastic;

c. a bearing journalled about the bushing, the bearing being anchored to the one of the moldboard and the reversing table to which the pin is not anchored;

whereby the bushing receives force exerted between the moldboard and the reversing table.

20. The plow of claim 19 wherein the bushing includes:

a. a rigid inner sleeve wherein the pin is received, and b. an elastic outer sleeve wherein the inner sleeve is situated.

* * * * *